US009888786B2

(12) United States Patent
Corso et al.

(10) Patent No.: US 9,888,786 B2
(45) Date of Patent: Feb. 13, 2018

(54) CHILD SLEEPING APPARATUS

(71) Applicant: KIDS II, INC., Atlanta, GA (US)

(72) Inventors: Daniel Corso, Atlanta, GA (US); Alexander Pusch, Chicago, IL (US)

(73) Assignee: KIDS II, INC., Atlanta, GA (US)

( * ) Notice: Subject to any disclaimer, the term of this patent is extended or adjusted under 35 U.S.C. 154(b) by 140 days.

(21) Appl. No.: 14/721,744

(22) Filed: May 26, 2015

(65) Prior Publication Data

US 2015/0342365 A1 Dec. 3, 2015

Related U.S. Application Data

(60) Provisional application No. 62/004,266, filed on May 29, 2014.

(51) Int. Cl.

| | |
|---|---|
| ***A47D 9/00*** | (2006.01) |
| ***A47D 13/10*** | (2006.01) |
| ***A47D 9/02*** | (2006.01) |

(52) U.S. Cl.

CPC ..... *A47D 9/005* (2013.01); *A47D 9/00* (2013.01); *A47D 9/02* (2013.01); *A47D 13/105* (2013.01)

(58) Field of Classification Search

CPC . A47D 9/00; A47D 9/005; A47D 9/02; A47D 13/00; A47D 13/02; A47D 13/06; A47D 13/061; A47D 13/063; A47D 13/068; A47D 13/102; A47D 13/105; A47D 13/107; B62B 9/22

See application file for complete search history.

(56) References Cited

U.S. PATENT DOCUMENTS

| | | | | |
|---|---|---|---|---|
| 4,377,011 | A | 3/1983 | Kinberger | |
| 5,172,435 | A | 12/1992 | Griffin et al. | |
| 5,947,552 | A | 9/1999 | Wilkins et al. | |
| 6,174,028 | B1 * | 1/2001 | Yang | A47D 13/102 280/642 |
| 6,257,659 | B1 | 7/2001 | Wilkins et al. | |
| 6,386,986 | B1 * | 5/2002 | Sonner | A47D 9/02 297/273 |
| 6,390,555 | B2 | 5/2002 | Wilkins et al. | |
| 6,594,840 | B2 * | 7/2003 | Tomas | A47D 9/00 5/101 |
| 6,682,137 | B2 * | 1/2004 | Hsia | A47D 13/102 297/183.4 |
| 6,687,928 | B1 * | 2/2004 | Wilson | A47D 7/002 403/59 |
| 6,851,745 | B2 | 2/2005 | Wilkins et al. | |
| 7,455,353 | B2 | 11/2008 | Favorito et al. | |
| 7,905,791 | B2 * | 3/2011 | Guang | 340/671 |
| 7,971,933 | B2 | 7/2011 | Tuckey et al. | |
| 8,038,207 | B2 | 10/2011 | Flannery | |
| 8,152,647 | B2 | 4/2012 | Tuckey et al. | |
| 8,316,481 | B2 | 11/2012 | Arnold, IV et al. | |
| 8,382,203 | B2 | 2/2013 | Gilbert et al. | |

(Continued)

*Primary Examiner* — Robert G Santos
*Assistant Examiner* — David R Hare
(74) *Attorney, Agent, or Firm* — Gardner Groff; Greenwald & Villanueva, PC

(57) ABSTRACT

A children's sleeping apparatus includes a structural support frame and a child receiving receptacle supported by the structural support frame. The child receiving receptacle is preferably movably coupled to the structural support frame to provide pivotal motion of the child receiving receptacle relative to the structural support frame.

15 Claims, 3 Drawing Sheets

(56) References Cited

U.S. PATENT DOCUMENTS

| | | | | |
|---|---|---|---|---|
| 8,746,794 | B2 * | 6/2014 | Oren | A47D 11/005 297/118 |
| 8,757,716 | B2 | 6/2014 | Ru et al. | |
| 8,844,072 | B2 * | 9/2014 | Bellows | A47D 9/02 5/101 |
| 8,845,028 | B2 * | 9/2014 | Miller | A47D 1/002 297/118 |
| 8,893,325 | B2 | 11/2014 | Arnold, IV et al. | |
| 8,919,871 | B2 | 12/2014 | Huntsberger et al. | |
| 9,102,348 | B2 | 8/2015 | Miller et al. | |
| 2005/0011004 | A1 | 1/2005 | Favorito et al. | |
| 2005/0241064 | A1 | 11/2005 | Lopes et al. | |
| 2007/0007804 | A1 * | 1/2007 | Pemberton | A47D 13/107 297/260.2 |
| 2011/0148155 | A1 | 6/2011 | Chapman et al. | |
| 2012/0046117 | A1 * | 2/2012 | Zhang | A47D 13/105 472/119 |
| 2013/0214574 | A1 * | 8/2013 | Chapman | A47D 13/10 297/258.1 |
| 2014/0075671 | A1 | 3/2014 | Haut et al. | |
| 2015/0173523 | A1 * | 6/2015 | Horst | A47D 7/01 5/11 |
| 2015/0342368 | A1 * | 12/2015 | Corso | A47D 9/02 297/271.5 |

* cited by examiner

CHILD SLEEPING APPARATUS

CROSS-REFERENCE TO RELATED APPLICATIONS

This application claims the benefit of U.S. Provisional Patent Application Ser. No. 62/004,266 filed May 29, 2014, the entirety of which is hereby incorporated herein by reference for all purposes.

TECHNICAL FIELD

The present invention relates generally to the field of children's accessories, and more particularly to sleeping apparatuses for children.

BACKGROUND

Children's sleeping apparatuses such as rockers, bassinets, sleepers and portable cribs are known in a variety of forms. Many such devices are bulky and cumbersome to transport or store compactly, or may be difficult for an adult caregiver to set up for use.

Accordingly, it can be seen that needs exist for improved sleeping apparatuses for children that can readily be reconfigured between a compact configuration for transport or storage and an expanded or upright configuration for use. It is to the provision of improved sleeping apparatuses for children meeting these and other needs that the present invention is primarily directed.

SUMMARY

The present invention relates to improved sleeping apparatuses for infants and small children. In example embodiments, the children's sleeping apparatus includes a structural support frame and a child receiving receptacle or sling supported from the frame for receiving and supporting an infant or small child therein in a reclined position, or alternatively in an upright position or a laying position. Further example embodiments can be adjustable between multiple positions.

In one aspect, the present invention relates to a children's sleeping apparatus including a structural support frame and a child receiving receptacle supported by the structural support frame. The child receiving receptacle is preferably movably coupled to the structural support frame to provide pivotal motion of the child receiving receptacle relative to the structural support frame.

In another aspect, the invention relates to a children's sleeping apparatus. The apparatus preferably includes a structural support frame having a first front leg pivotally coupled to a first back leg at a first pivotal hub, and a second front leg pivotally coupled to a second back leg at a second pivotal hub. The apparatus preferably also includes a child receiving receptacle having upper and lower arcuate sling support elements coupled to the first and second pivotal hubs, and a soft goods receiver attached to the upper and lower arcuate sling support elements. The child receiving receptacle is preferably pivotally movable relative to the structural support frame, and a biasing spring preferably biases the child receiving receptacle toward an equilibrium position relative to the structural support frame.

In still another aspect, the invention relates to a children's sleeping apparatus including a structural support frame having first and second arcuate arch supports with a semicircular geometry, and preferably also including a carrier mounted at an upper medial portion of each of the first and second arcuate arch supports. The carriers each preferably define a bearing channel extending therethrough. The apparatus preferably also includes a child receiving receptacle having a support with arcuate medial side portions, and the arcuate medial side portions preferably slide though the bearing channels of the carriers as the child receiving receptacle moves along a gliding path of motion relative to the structural support frame. In alternate embodiments, the support members can be triangular, rectangular, or otherwise configured.

In another aspect, the invention relates to a children's sleeping apparatus including a structural support frame having a generally rectangular support ring including an upper frame member, a lower frame member, and first and second side frame members. The support ring defines an opening bounded by the upper frame member, the lower frame member, and the first and second side frame members, and the frame members have a rectangular cross-sectional profile defining a width and a thickness, the width being substantially greater than the thickness. The support ring preferably defines a support ring plane and further includes twisting corner transitions connecting adjacent ends of the frame members, whereby the first and second side frame members have a width-wise dimension aligned generally parallel to the support ring plane, and the top and bottom frame members have a width-wise dimension aligned at an oblique angle relative to the support ring plane. The rectangular support ring preferably further includes support legs pivotally connected to the first and second side frame members of the support ring. The apparatus preferably further includes a child receiving receptacle pivotally connected to the structural support frame, and configured to fit nestingly within the opening of the support ring. In alternate embodiments, the support ring can be ovular or have curved portions, for example having a base portion curved for rocking.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figures 1A, 1B:
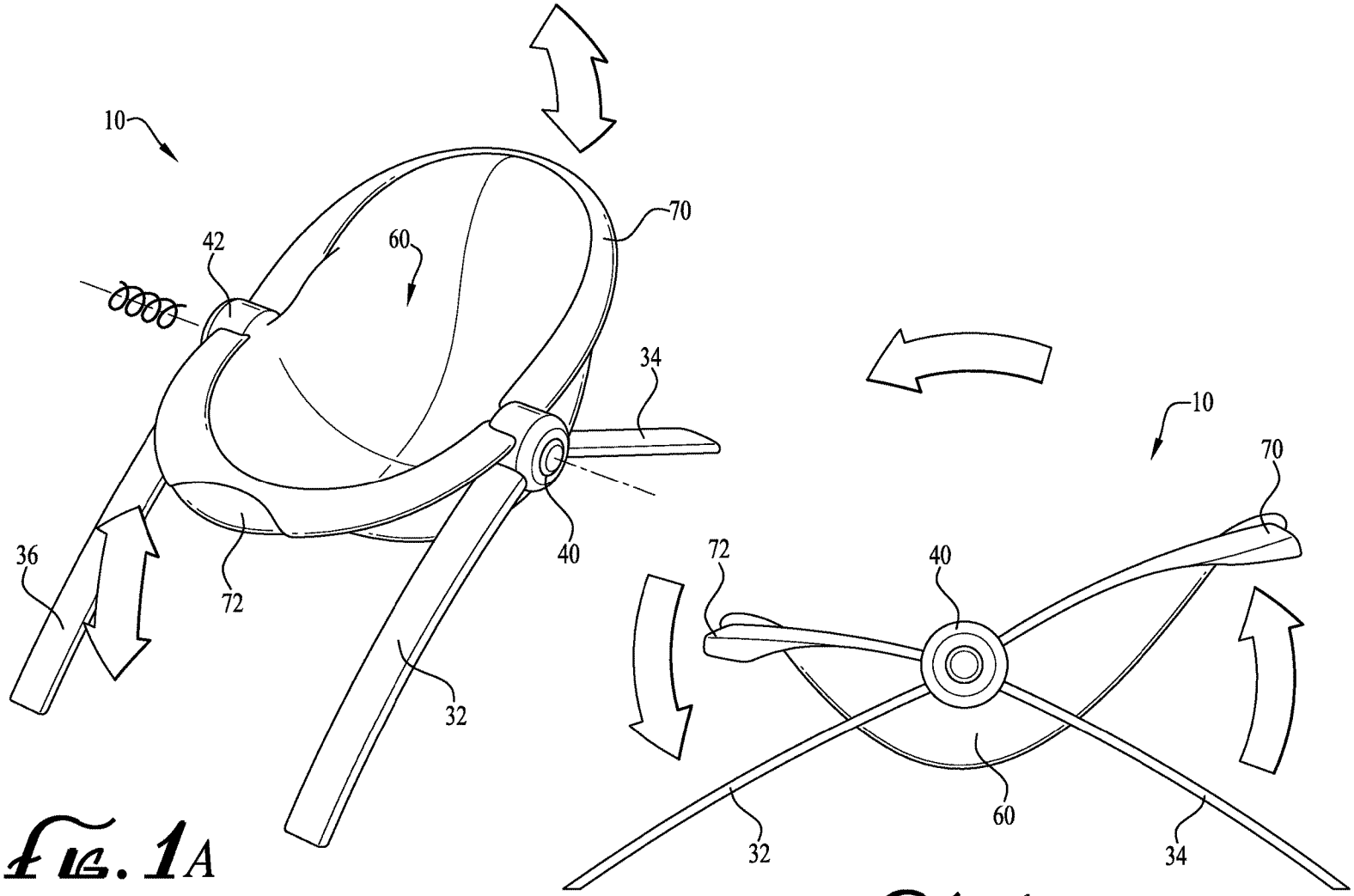
FIGS. 1A and 1B show perspective and side views, respectively, of a children's sleeping apparatus according to an example embodiment of the present invention.

With reference now to the drawing figures, wherein like reference numbers represent corresponding parts throughout the several views, FIGS. 1A and 1B show a children's sleeping apparatus 10 in the form of a spring sleeper, according to an example embodiment of the invention. The apparatus 10 generally comprises a structural support frame 30 and a child receiving receptacle or sling 60 supported from the frame 30 for receiving and supporting an infant or small child therein in a reclined or recumbent position. Alternatively, he sleeping apparatus supports a child in an upright seated position. In further embodiments, the apparatus includes a recline adjustment that allows the child receiving receptacle 60 to be selectively oriented in multiple positions. The receptacle 60 can recline or incline with respect to the support frame, or the backrest portion of the receptacle can recline or incline with respect to the footrest portion of the receptacle.

The support frame 30 of the depicted embodiment comprises a plurality of legs for supporting the apparatus 10 on a floor, the ground or another support surface. In the depicted embodiment, a first or right side leg assembly comprises a first front leg 32 and a first rear leg 34, coupled at proximal or top ends thereof by a first connecting hub 40; and a second or left side leg assembly comprises a second front leg 36 and a second rear leg (unshown), coupled at proximal or top ends thereof by a second connecting hub 42. The support legs can be fabricated from metal, plastic or other structural materials of construction sufficiently rigid to support the intended weight of the sleeper and child. In the depicted embodiment, the distal or bottom ends of the legs comprise free ends terminating in feet for supporting the apparatus on a floor, the ground, or other support surface. In alternate embodiments distal or bottom ends of the legs may be interconnected by one or more cross-members or braces.

The child receiving receptacle or sling 60 preferably comprises a flexible fabric or soft goods material forming a concave (from the top) receiver for supporting an infant or small child therein. The fabric or soft goods material of the child receiving receptacle or sling 60 is preferably attached about its periphery to upper and lower semi-circular or arcuate sling support elements 70, 72 formed of tubing or other structural members configured to bear the weight of the sling and a child supported therein. The soft goods material of the child receiving receptacle or sling 60 is optionally collapsible when not in use to lie generally flat or conform to the profile of the sling support elements 70, 72 for compact storage. Each of the upper and lower semi-circular sling support elements 70, 72 has first and second ends attached to the first and second connection hubs 40, 42, forming a loop between the ends that define the head and foot ends of the child receiving receptacle or sling 60.

The child receiving receptacle or sling 60 is optionally pivotally coupled to the frame 30, for example by rotational bearings within the connection hubs 40, 42, such that the child receiving receptacle or sling can rock or rotate with respect to the frame, as indicated by the directional arrows in the figures. The rotation or rocking can be manually or motor driven. Optionally, a torsion or coil spring is engaged within the hubs 40, 42, operable between the frame 30 and the child receiving receptacle or sling 60 to limit the range of rotation or rocking, and bias the child receiving receptacle or sling toward its neutral or equilibrium position.

Optionally, the front legs 32, 36 are hingedly coupled to the back legs 34 (and the unseen back left leg) by the connection hubs 40, 42 to allow the frame to be folded and reconfigured from the expanded or upright configuration with the front and rear legs spread apart as shown when in use, into a folded or compact configuration with the front and rear legs folded together for storage or transport. The upper and lower semi-circular or arcuate sling support elements 70, 72 carrying the child receiving receptacle or sling 60 are optionally also hingedly coupled, foldable or collapsible to allow reconfiguration between the expanded configuration shown and a folded or compact configuration.

Figure 2A:
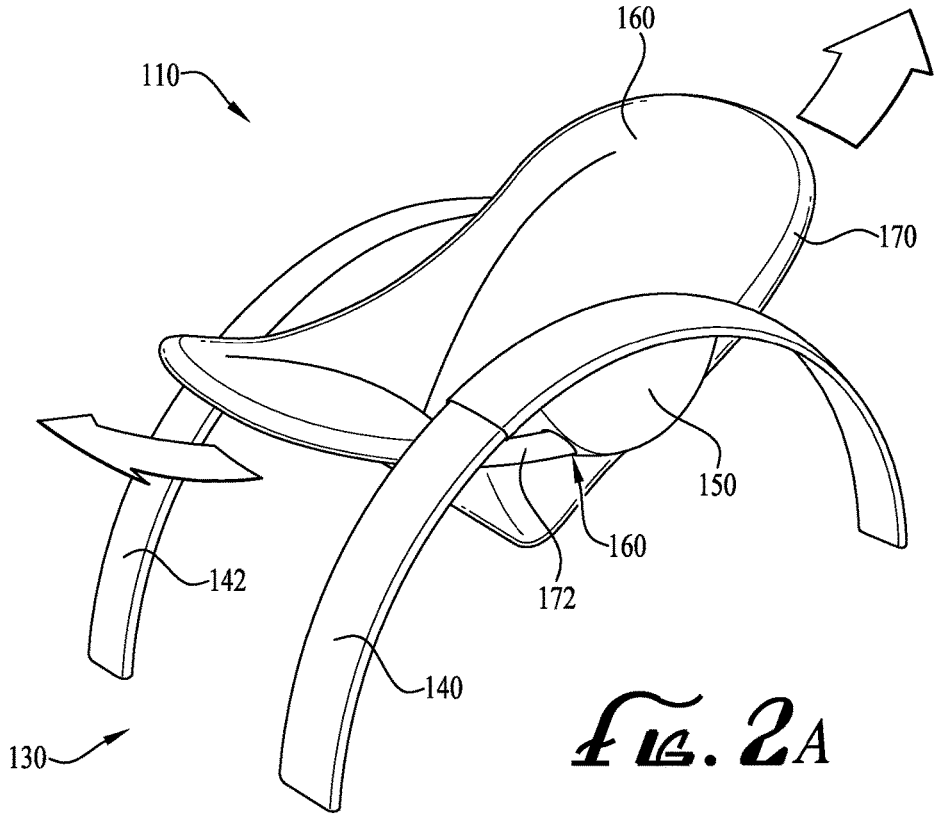
FIGS. 2A and 2B show perspective and side views, respectively, of a children's sleeping apparatus according to another example embodiment of the present invention.
Figure 2B:
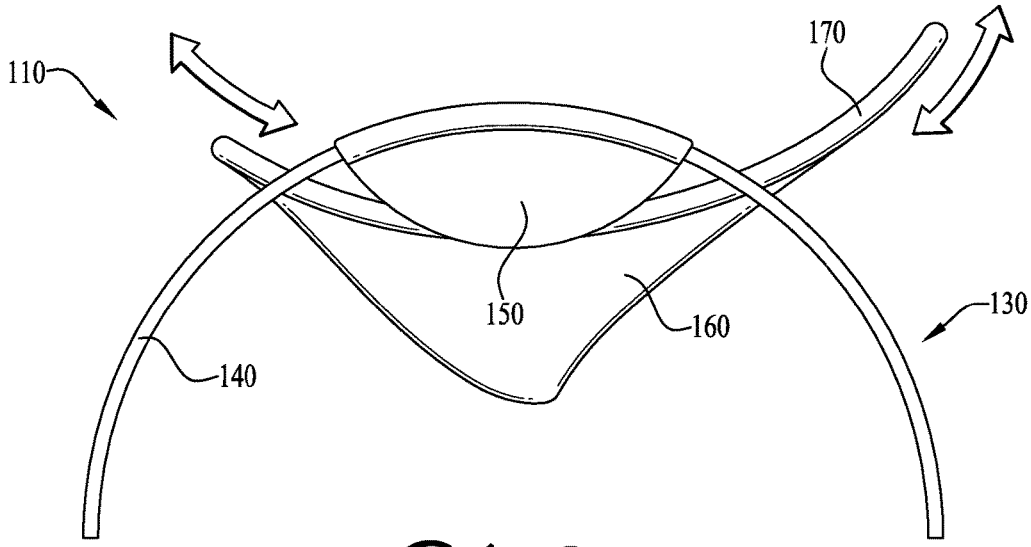

FIGS. 2A and 2B show a children's sleeping apparatus 110 in the form of a glider, according to another example embodiment of the invention. The apparatus 110 generally comprises a structural support frame 130 and a child receiving receptacle or sling 160 supported from the frame 130 for receiving and supporting an infant or small child therein in a reclined or recumbent position.

The support frame 130 of the depicted embodiment comprises a first side support 140 and an opposite second side support 142. Each of the first and second side supports 140, 142 comprises a generally semi-circular or arcuate arch having feet at lower ends on both sides thereof, and an upper medial portion between the ends forming a peak or top segment of the supports. A carrier bracket or housing 150 is mounted to each of the first and second side supports 140, 142 at their upper medial portions. The carrier bracket or housing 150 optionally defines a channel or bearing path 152 extending axially therethrough for supporting and/or guiding motion of the child receiving receptacle or sling 160 supported therein.

The child receiving receptacle or sling 160 preferably comprises a flexible fabric or soft goods material forming a concave (from the top) receiver for supporting an infant or small child therein. The fabric or soft goods material of the child receiving receptacle or sling 160 is preferably attached about its periphery to a circumferential hoop or sling support 170, and is collapsible when not in use to generally conform or lie flat with the circumferential sling support. In example embodiments, the circumferential hoop or sling support 170 is formed of structural metal or plastic tubing, and has concave arcuate medial side portions 172, which glide or slide along or though the channel or bearing path 152 in the first and second side supports 140, 142 of the frame 130. In alternate embodiments, the child receiving receptacle comprises a more rigid, bucket-style seat, or other seat configuration.

In this manner, the child receiving receptacle or sling 160 is configured for sliding or gliding movement with respect to the frame, and the concave arcuate profile of the medial side portions 172 of the sling support 170 imparts an rocking or pivotal component of motion to the child receiving receptacle or sling 160, in addition to the forward and back axial sliding motion component, as indicated by the direction arrows. The motion of the child receiving receptacle or sling 160 relative to the frame 130 can be manually powered by a caregiver or can be motor driven Optionally, the frame 130 can be collapsible, for example by hinged connections between segments of the first and second side supports 140, 142, by telescoping sliding engagement between segments of the first and second side supports, by detachability of front and rear segments of the first and second side supports from the carrier bracket or housing 150, or otherwise. The child receiving receptacle or sling 160 is optionally removable from the carrier bracket or housing 150 of the frame 130 to allow the sling to collapse and nest within the first and second side supports 140, 142 for compact storage and transport. In further example embodiments, the seat 160 is configured to collapse into a compact configuration without being removed.

Figure 3A:
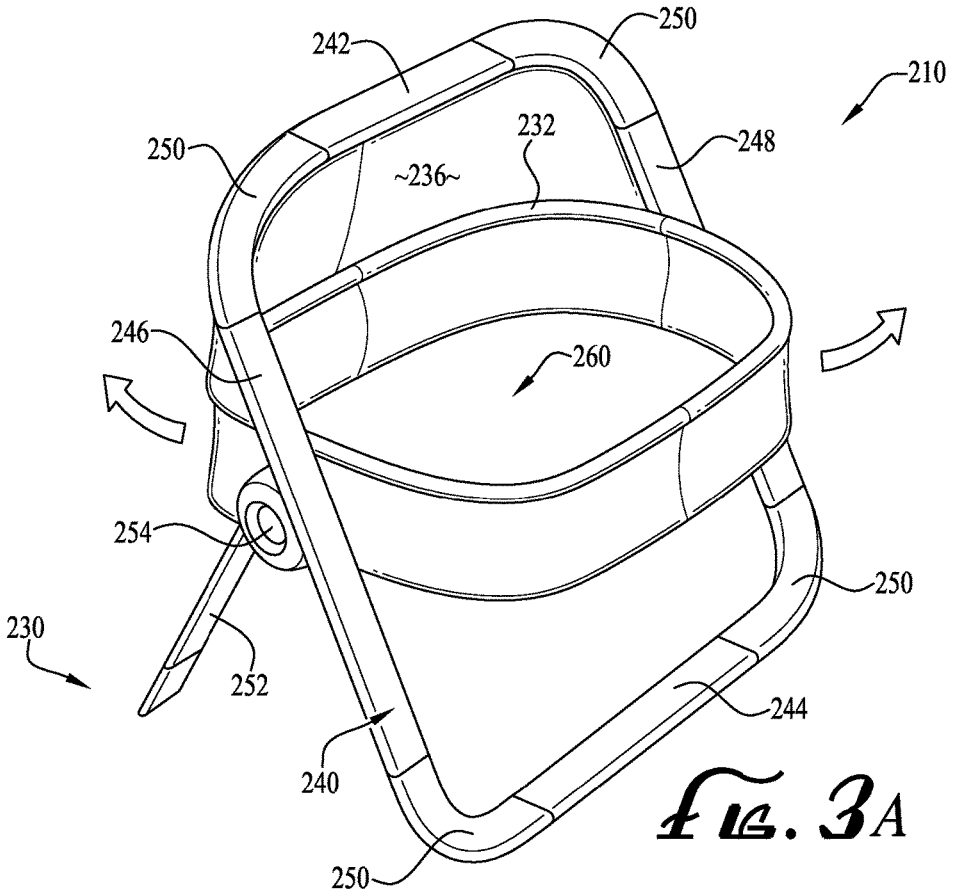
FIGS. 3A and 3B show perspective and side views, respectively, of a children's sleeping apparatus according to another example embodiment of the present invention.
Figure 3B:
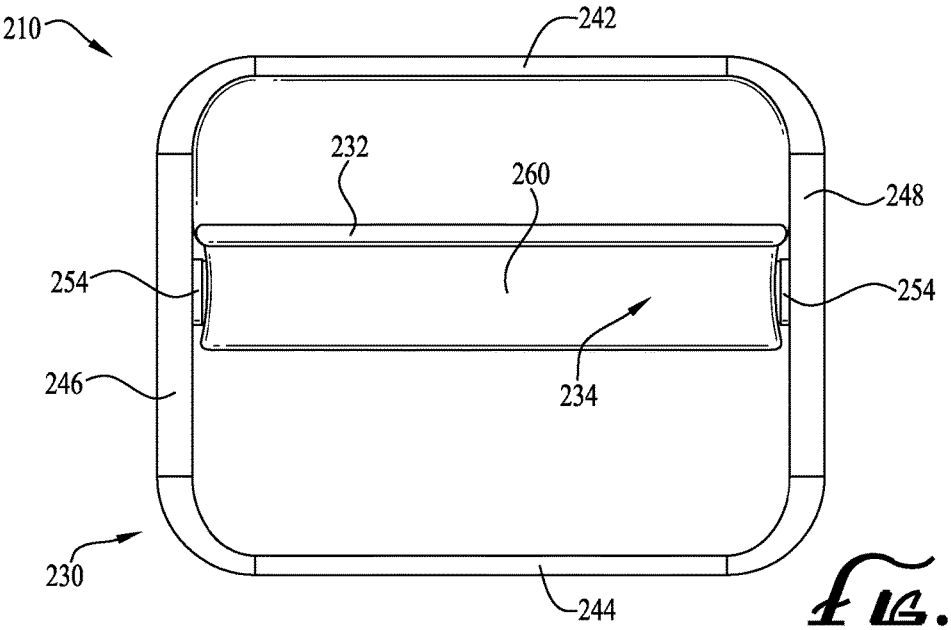

FIGS. 3A and 3B show a children's sleeping apparatus 210 in the form of a baby sleeper frame, according to another example embodiment of the invention. The apparatus 210 generally comprises a structural support frame 230 and a child receiving receptacle or sling 260 supported from the frame 230 for receiving and supporting an infant or small child therein in a reclined or recumbent position.

The support frame 230 of the depicted embodiment comprises a generally rectangular support ring 240 comprising an upper frame member 242, a base or lower frame member 244, and first and second side frame members 246, 248 defining an opening within the support ring 240 bounded by the frame members. Optionally, corner transitions 250 connect adjacent ends of the frame members. In the depicted example, the frame members 242, 244, 246 and 248 comprise elongate bars or tubes having a rectangular cross-sectional profile defining a width and a thickness, the width being substantially greater than the thickness; and the corner transitions 250 comprise twist transitions providing an offset in twist angle between the top and bottom frame members 242, 244, and the first and second side frame members 246, 248. Thus, as seen best with reference to FIG. 3B, the first and second side frame members 246, 248 have their width-wise dimensions aligned generally parallel to a plane defined by the rectangular support ring 240, whereas the top and bottom frame members 242, 244 have their width-wise dimensions aligned at an oblique angle relative to the plane of the support ring. This oblique angle of the top and bottom frame members 242, 244 relative to the plane of the support ring 240 is preferably selected to generally correspond to the inclination angle of the support ring when the apparatus 210 is set up for use as shown in FIG. 3A, such that the bottom frame member's widthwise dimension rests generally flat on the floor or other support surface below. While in the depicted embodiment the support ring 240 is generally rectangular, in alternate embodiments the support ring may be more ovular and/or have one or more curved portions. For example, the bottom frame member 244 is optionally curved along at least a portion of its length to allow for rocking of the apparatus.

The support frame 230 further comprises kickstand braces or legs 252 pivotally mounted to the support ring 240, for example by a rotational hub or hinge mechanism 254. Optionally, the legs 252 are connected to one another by a second bottom frame member, for example to provide structural integrity and/or having a curved profile configured for rocking. A first leg 252 is depicted in FIG. 3A extending from the hub 254 attached to the first side frame member 246, and a second leg (unshown) extends in similar fashion from an opposite hub attached to the second side frame member 248. The legs 252 preferably fold flat against the support ring 240 into a compact configuration for transport or storage, and pivot outwardly from the support ring to an extended configuration as shown in FIG. 3A for use. In example forms, in the extended configuration, the legs 252 define an angle of between about 30°-120°, or more preferably about 45°-105°, for example about 75°-90°.

The child receiving receptacle or sling 260 is supported by a peripheral receptacle support frame 232, to which a fabric or soft goods shell 234 defining a base panel and sidewalls is attached. The receptacle support frame 232 is in turn supported from the frame 230 by the rotational hubs or hinge mechanisms 254 at each side of the support ring 240. In this manner, the child receiving receptacle or sling 260 is optionally pivotally coupled to the frame 230 such that the child receiving receptacle can rotate or swing with respect to the frame to impart a cradling or rocking motion to a child occupant. The motion of the child receiving receptacle or sling 260 can be manually driven or motor driven. The child receiving receptacle or sling 260 optionally further comprises a hood 236 covering at least a portion of the area over the child receiving receptacle, for example a fabric or soft goods panel extending between the receptacle support frame 232 and the top frame member 242. The hood 236 is preferably flexible and optionally elastic to allow rocking of the child receiving receptacle 260 within a defined range of motion, and to collapse when the apparatus 210 is folded.

The apparatus 210 is optionally collapsible between the erected or in-use configuration depicted in FIG. 3A, wherein the legs 252 are extended from the support ring 240 and the child receiving receptacle 260 is generally horizontal and non-aligned with the support ring of the frame; and a compact or folded configuration wherein the legs 252 are folded against the support ring 240, and the child receiving receptacle 260 is generally aligned with the support ring of the frame. The receptacle support frame 232 is optionally configured to nestingly fit entirely within the periphery of the support ring 240 of the frame 230 in the compact or folded configuration of the apparatus, such that the inner dimensions of the support ring 240 generally conform to and are slightly larger than the outer dimensions of the receptacle support frame 232. Alternatively, the receptacle support frame can fold along a centerline of the long axis of the child receiving receptacle.

In an example method of use according to the present invention, a children's sleeping apparatus is erected for use by positioning the frame in its upright or expanded configuration. The child receiving receptacle or sling is mounted to the frame and deployed. A caregiver may then place an infant or small child into the child receiving receptacle to allow the child to sleep, rest or play. After use, the child is lifted out of the child receiving receptacle, and the apparatus is optionally folded or collapsed into its compact configuration for storage or transport.

While the invention has been described with reference to preferred and example embodiments, it will be understood by those skilled in the art that a variety of modifications, additions and deletions are within the scope of the invention, as defined by the following claims.

What is claimed is:

1. A children's sleeping apparatus comprising:

a structural support frame comprising:

a support ring comprising an upper frame portion, a lower frame portion, and first and second side frame portions extending between opposite ends of the upper and lower frame portions;

a first rotational hub coupled to the first side frame portion;

a second rotational hub coupled to the second side frame portion; and a first support leg pivotally coupled to the first rotational hub and a second support leg pivotally coupled to the second rotational hub to allow pivotal motion of the first and second support legs relative to the support ring; and a child receiving receptacle coupled to the first and second rotational hubs allow pivotal motion of the child receiving receptacle relative to the structural support frame.

2. The children's sleeping apparatus of claim 1, wherein the structural support frame comprises first and second pairs of front and rear legs, the front and rear legs being pivotally coupled to one another.

3. The children's sleeping apparatus of claim 2, wherein the front and rear legs are pivotally coupled to one another by a rotational hub.

4. The children's sleeping apparatus of claim 3, wherein the child receiving receptacle is also mounted to the rotational hub.

5. The children's sleeping apparatus of claim 4, wherein the rotational hub comprises a spring biasing the child receiving receptacle toward an equilibrium position relative to the structural support frame.

6. The children's sleeping apparatus of claim 2, wherein the child receiving receptacle is collapsible, and wherein the children's sleeping apparatus is reconfigurable between an expanded configuration with the front and rear legs extended relative to one another and the child receiving receptacle in a deployed position, and a compacted configuration with the front and rear legs folded together and the child receiving receptacle in a collapsed position.

7. The children's sleeping apparatus of claim 1, wherein the structural support frame is collapsible.

8. The children's sleeping apparatus of claim 1, wherein the child receiving receptacle comprises a soft goods material attached about its periphery to a circumferential hoop support.

9. The children's sleeping apparatus of claim 8, wherein the soft goods material of the child receiving receptacle is collapsible to generally conform to the circumferential hoop support when not in use.

10. The children's sleeping apparatus of claim 1, wherein the support ring is generally rectangular.

11. The children's sleeping apparatus of claim 10, wherein the support ring comprises a rectangular cross-sectional profile defining a width and a thickness, the width being substantially greater than the thickness.

12. The children's sleeping apparatus of claim 11, wherein the support ring defines a support ring plane and further comprises twisting corner transitions connecting adjacent ends of the frame portions, whereby the first and second side frame portions have a width-wise dimension aligned generally parallel to the support ring plane, and the top and bottom frame portions have a width-wise dimension aligned at an oblique angle relative to the support ring plane.

13. The children's sleeping apparatus of claim 10, wherein the support ring defines an opening bounded by the upper frame portion, the lower frame portion, and the first and second side frame portions, and wherein the child receiving receptacle is configured to fit within the opening of the support ring.

14. The children's sleeping apparatus of claim 10, wherein the child receiving receptacle further comprises a hood attached to the upper frame portion of the support ring.

15. A children's sleeping apparatus comprising:

a structural support frame comprising a support ring comprising an upper frame portion, a lower frame portion, and first and second side frame portions, and defining an opening bounded by the upper frame portion, the lower frame portion, and the first and second side frame portions, wherein the frame portions each comprise a cross-sectional profile defining a width and a thickness, the width being substantially greater than the thickness, and wherein the support ring defines a support ring plane and further comprises twisting corner transitions connecting adjacent ends of the frame portions, whereby the first and second side frame portions have a width-wise dimension aligned generally parallel to the support ring plane, and the top and bottom frame portions have a width-wise dimension aligned at an oblique angle relative to the support ring plane;

a first support leg pivotally connected to the first side frame portion of the support ring by a first rotational hub and a second support leg pivotally connected to the second side frame portion of the support ring by a second rotational hub; and a child receiving receptacle pivotally connected to the structural support frame by the first and second rotational hubs, and configured to fit nestingly within the opening of the support ring when the children's sleeping apparatus is in a folded configuration where the first and second support legs are folded against the support ring.

* * * * *